US007168219B2

(12) United States Patent
Elderson

(10) Patent No.: US 7,168,219 B2
(45) Date of Patent: Jan. 30, 2007

(54) SUPPORT APPARATUSES AND JAMBS FOR WINDOWS AND DOORS AND METHODS OF CONSTRUCTING SAME

(75) Inventor: William L. Elderson, N. Royalton, OH (US)

(73) Assignee: Dietrich Industries, Inc., Pittsburgh, PA (US)

( * ) Notice: Subject to any disclaimer, the term of this patent is extended or adjusted under 35 U.S.C. 154(b) by 0 days.

(21) Appl. No.: 10/325,570

(22) Filed: Dec. 20, 2002

(65) Prior Publication Data

US 2003/0089053 A1 May 15, 2003

Related U.S. Application Data

(62) Division of application No. 09/888,897, filed on Jun. 25, 2001.

(60) Provisional application No. 60/229,583, filed on Aug. 31, 2000.

(51) Int. Cl.
*E04C 2/42* (2006.01)

(52) U.S. Cl. ..... 52/667; 52/481.2; 52/653.1; 52/655.1; 52/668; 52/731.5; 52/731.9

(58) Field of Classification Search ..... 52/220.1, 52/730.1, 731.7, 731.9, 568, 570, 733.2, 52/736.2, 667, 739.1, 668, 653.1, 669, 655.1, 52/655.2, 481.1, 481.2, 745.09, 731.5; 403/375, 403/315–317

See application file for complete search history.

(56) References Cited

U.S. PATENT DOCUMENTS

| | | | |
|---|---|---|---|
| 839,723 | A | 12/1906 | Bury |
| 894,711 | A | 7/1908 | Worcester |
| 992,941 | A | 5/1911 | Danielson |
| 1,101,745 | A | 6/1914 | Jones |
| 1,346,426 | A | 7/1920 | Scherbner |

(Continued)

FOREIGN PATENT DOCUMENTS

| | | | |
|---|---|---|---|
| AU | 428 738 | B | 10/1972 |

(Continued)

OTHER PUBLICATIONS

"Don't Just Space It, Brace-It", brochure, publication date unknown, Truswal Systems, Arlington, Texas.

(Continued)

*Primary Examiner*—Jeanette E. Chapman
*Assistant Examiner*—Yvonne M. Horton
(74) *Attorney, Agent, or Firm*—Kirkpatrick & Lockhart Nicholson Graham LLP

(57) ABSTRACT

A support structure such as, for example, a door jamb and a window jamb. In one embodiment, the jamb is formed from a first stud that has a web and two first flanges and a second stud with a second web and second flanges. The first stud has at least one first hole through the first web and the second stud has at least one second hole through the second web. The first and second studs are oriented such that at least one first hole is aligned with at least one second hole and a stud engager is inserted through the aligned holes to retain the studs in abutting contact to form the jamb.

50 Claims, 10 Drawing Sheets

U.S. PATENT DOCUMENTS

| | | | |
|---|---|---|---|
| 1,475,387 | A | 11/1923 | Holmes |
| 1,561,976 | A | 11/1925 | Donahoe, Jr. |
| 1,603,678 | A | 10/1926 | Furey |
| 1,656,741 | A | 1/1928 | Lane |
| 1,750,039 | A | 6/1930 | Feltes |
| 1,791,197 | A | 2/1931 | Dickson |
| 2,102,936 | A | 12/1937 | Bailey |
| 2,245,908 | A | 7/1941 | Drake |
| 2,430,654 | A | 11/1947 | Voege |
| 2,686,959 | A | 8/1954 | Robinson |
| 2,856,646 | A | 10/1958 | Latimer et al. |
| 2,873,828 | A | 2/1959 | Zitomer |
| 2,918,995 | A | 12/1959 | Kruger |
| 2,963,127 | A | 12/1960 | Manville |
| 2,964,807 | A | 12/1960 | Kennedy |
| 3,010,162 | A | 11/1961 | Klein |
| 3,201,874 | A | 8/1965 | Christy |
| 3,305,981 | A | 2/1967 | Biggs et al. |
| 3,322,447 | A | 5/1967 | Biggs |
| 3,374,591 | A | 3/1968 | Tillisch et al. |
| 3,482,369 | A | 12/1969 | Burke |
| 3,562,970 | A | 2/1971 | Schwartz |
| 3,653,172 | A | 4/1972 | Schwartz |
| 3,755,988 | A | 9/1973 | Van Der Stuys |
| 4,018,020 | A | 4/1977 | Sauer et al. |
| 4,031,594 | A | 6/1977 | Cepuritis |
| 4,036,307 | A | 7/1977 | Marais |
| 4,043,689 | A | 8/1977 | Spencer et al. |
| 4,075,810 | A | 2/1978 | Zakrzewski et al. |
| 4,128,979 | A | 12/1978 | Price |
| 4,208,851 | A | 6/1980 | Sauer |
| 4,225,265 | A | 9/1980 | Hooker et al. |
| 4,235,054 | A | 11/1980 | Cable et al. |
| 4,246,736 | A | 1/1981 | Kovar et al. |
| 4,426,822 | A | 1/1984 | Gailey |
| 4,448,004 | A | 5/1984 | Thorsell |
| 4,522,009 | A | 6/1985 | Fingerson |
| 4,604,845 | A | 8/1986 | Brinker |
| 4,625,415 | A | 12/1986 | Diamontis |
| 4,693,047 | A | 9/1987 | Menchetti |
| 4,727,704 | A | 3/1988 | Carlton |
| 4,791,766 | A | 12/1988 | Egri, II |
| 4,809,476 | A | 3/1989 | Satchell |
| 4,840,005 | A | 6/1989 | Cochrane |
| 4,843,726 | A | 7/1989 | Ward |
| 4,850,169 | A | 7/1989 | Burkstrand et al. |
| 4,858,407 | A | 8/1989 | Smolik |
| 4,860,791 | A | 8/1989 | Putnam |
| 4,914,878 | A | 4/1990 | Tamaki et al. |
| 5,127,760 | A | 7/1992 | Brady |
| 5,155,962 | A | 10/1992 | Burkstrand et al. |
| 5,197,247 | A | 3/1993 | Elderson |
| 5,274,973 | A | 1/1994 | Liang |
| 5,287,644 | A | 2/1994 | Schiller et al. |
| 5,287,664 | A | 2/1994 | Schiller et al. |
| 5,325,651 | A | 7/1994 | Meyer et al. |
| 5,363,622 | A | 11/1994 | Sauer |
| 5,488,198 | A | 1/1996 | Kramer |
| 5,600,926 | A | 2/1997 | Ehrlich |
| 5,605,024 | A | 2/1997 | Sucato et al. |
| 5,632,128 | A | 5/1997 | Agar |
| 5,682,935 | A | 11/1997 | Bustamante |
| 5,720,138 | A | 2/1998 | Johnson |
| 5,784,850 | A | 7/1998 | Elderson |
| 5,822,942 | A | 10/1998 | Lucia, Jr. |
| 5,870,874 | A | 2/1999 | Brothers |
| 5,899,041 | A | 5/1999 | Durin |
| 5,904,023 | A | 5/1999 | diGirolamo et al. |
| 5,964,071 | A | 10/1999 | Sato |
| 6,021,618 | A | 2/2000 | Elderson |
| 6,114,012 | A | 9/2000 | Amaoka et al. |
| 6,164,028 | A | 12/2000 | Hughes |
| 6,199,336 | B1 | 3/2001 | Poliquin |
| 6,241,199 | B1 | 6/2001 | Ismert |
| 6,301,854 | B1 | 10/2001 | Daudet et al. |
| 6,418,695 | B1 | 7/2002 | Daudet et al. |
| D463,575 | S | 9/2002 | Daudet et al. |
| 6,578,335 | B2 | 6/2003 | Poliquin |
| 6,662,520 | B1 | 12/2003 | Nelson |
| 6,694,695 | B2 | 2/2004 | Collins et al. |
| 6,701,689 | B2 | 3/2004 | diGirolamo |
| 6,708,460 | B1 | 3/2004 | Elderson |
| 6,739,562 | B2 | 5/2004 | Rice |
| 2002/0059773 | A1 | 5/2002 | Elderson |
| 2003/0037494 | A1 | 2/2003 | Collins et al. |
| 2003/0145537 | A1 | 8/2003 | Bailey |

FOREIGN PATENT DOCUMENTS

| | | |
|---|---|---|
| AU | 30388 | 10/1972 |
| DE | 9003667 U | 5/1990 |
| GB | 593443 | 10/1947 |
| GB | 764052 A | 12/1956 |
| GB | 2103264 A | 2/1983 |
| GB | 2103264 A | 2/1983 |
| WO | WO 93/24712 | 12/1993 |
| WO | WO 96/23945 | 10/1996 |
| WO | WO 00/66844 | 9/2000 |
| WO | PCT/US00/11991 | 11/2000 |

OTHER PUBLICATIONS

U.S. Appl. No. 10/383,047, Brunt.
U.S. Appl. No. 10/641,062, Elderson.
U.S. Appl. No. 60/229,583, Bridging system for Off Module Studs.
PCT/US00/11991 International Patent Application, Stud Wall System and Method Using Combined Bridging Spacing Device.
U.S. Appl. No. 10/867,803, Elderson.
Metal Lite Inc., Brochure—Products That Meet The New A.D.A. Code Flush Mount and Notch Tite and Other Products; Fire Blocking, SLP-TRK and Specialty Items, Anaheim, CA, 1991.

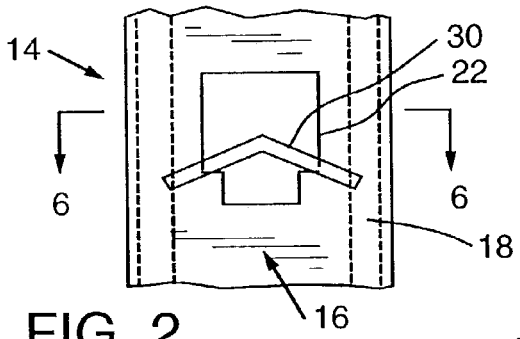
FIG. 2
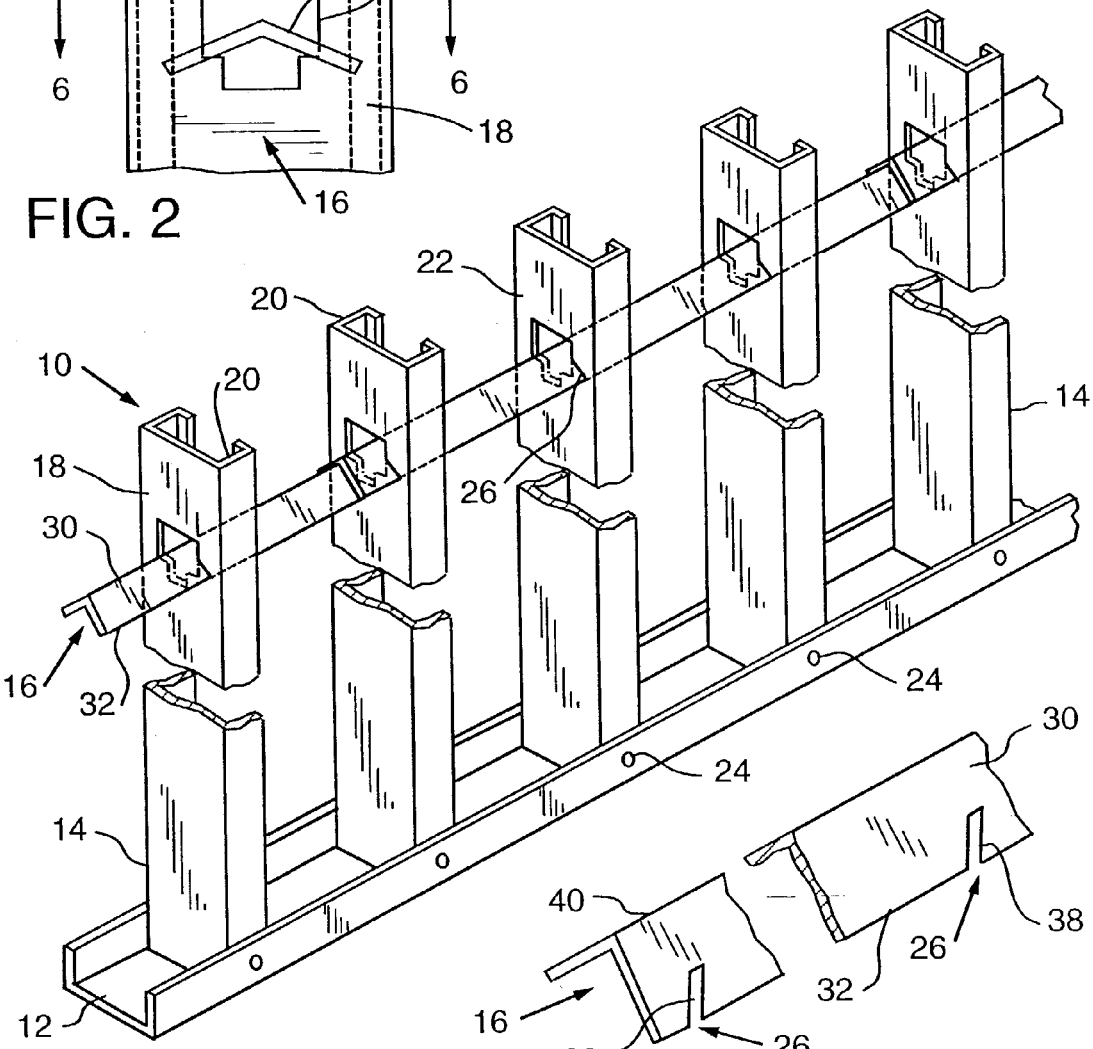
FIG. 1
FIG. 3
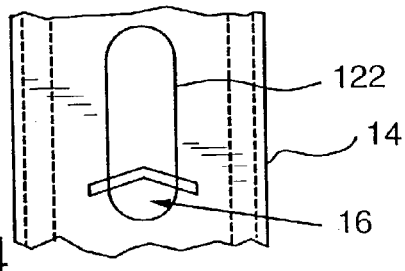
FIG. 4

SUPPORT APPARATUSES AND JAMBS FOR WINDOWS AND DOORS AND METHODS OF CONSTRUCTING SAME

CROSS-REFERENCE TO RELATED APPLICATIONS

This non-provisional application for patent is a divisional patent application of U.S. patent application Ser. No. 09/888,897, filed Jun. 25, 2001 which claims priority from U.S. Provisional Patent Application Serial No. 60/229,583, Filed Aug. 31, 2000.

FEDERALLY SPONSORED RESEARCH

Not applicable.

BACKGROUND OF THE INVENTION

1. Field of the Invention

The invention herein described relates generally to stud wall systems and more particularly to a device for spacing and bridging studs in a stud wall, and connecting devices for use with spacing and bridging members.

2. Description of the Invention Background

Metal studs are used to form walls in building structures today, including load bearing walls such as exterior walls and curtain walls. In a typical installation, the metal studs are secured by screws at their lower ends to a bottom track secured to a floor, and extend at their upper ends into a top track secured to overhead joists which may form the framework for an upper floor. The upper ends of the studs generally also are secured to the top track. Exterior wall materials and/or wall boards or other panels are applied to the sides of the studs to form a closed wall structure.

The load bearing walls are subject to axial loads (compressive loads on the studs) applied to the studs through the overhead joists, and also may be subject to transverse loads (for example, exterior walls may be subject to transverse loads from wind effects) and lateral loads acting in the plane of the wall. These loads may cause flexing (including bowing, twisting or other deformation of the stud) or turning of the metal studs which may cause the walls to crack or otherwise be flawed or damaged. In load bearing walls, this problem is structural as well as aesthetic.

Bridging systems heretofore have been used to reinforce the metal stud walls by adding structural support between adjacent studs. Three known bridging systems include braced channel, welded channel, and block-and-strap bridging systems.

In the braced channel bridging system, an U-shape channel spans two or more metal studs, extending through a conduit hole in the web of each stud. An angled brace is fastened to both the channel and the web of the stud, generally with screws or rivets.

The welded channel bridging system also uses an U-shape channel which spans two or more metal studs and extends through conduit holes in the webs of the studs. The channel is then welded to the studs on one or both sides of the channel.

In the block-and-strap bridging system, sheet metal "blocks" are fastened between adjacent studs through bent tabs at their distal ends. Then a strap is fastened to one or both sides of two or more metal studs as well as to the respective side or sides of the blocks. Thus the studs are interconnected by the blocks between the studs as well as the straps along the sides of the studs, and the blocks and straps also are connected to each other.

The installation of metal stud wall systems, including the reinforcing bridging systems, heretofore has been a time consuming process. In a typical installation where the metal studs are fastened at their upper ends to a top track or channel, the attachment positions of the studs are marked off along the top track. Then each stud is fastened to each flange of the top track by screws. A ladder or a scaffold may be required if the top track is too high for the installer to reach. If a ladder is used, the installer climbs the ladder and fastens as many studs as he can reach to the near flange of the top track. Then, he must climb down the ladder, move the ladder along the wall so that when he again climbs the ladder he can reach the next one or more studs for fastening to the top track. If a scaffold is used, much more time is expended setting up the scaffold. After doing this along one side of the wall, the process is repeated on the other side of the wall to fasten the studs to the other flange of the top track.

The metal studs must then be fastened at their lower ends to a bottom track or channel. Each stud must be carefully aligned and squared before being fastened to the bottom track. In addition, the bridging members described above also must be installed to interconnect the metal studs at one or more points between the top and bottom tracks. Because of the time consuming nature of the installation process, fasteners can be missed or forgotten. In the welded channel bridging systems, welders and their equipment are relatively expensive, and welds also can be missed, or can be improperly formed. Defects in welds can be particularly difficult to detect.

In addition, once the studs are installed, other trades people, such as plumbers and electricians, may remove the bridging members between two studs to give them more room to work, running plumbing lines or electrical lines, for example. If the bridging member is not replaced, the strength of the wall may be reduced. It would be desirable to have a device for holding the bridging member in place. In certain situations, the bridging member may not fit tightly with the web of a stud and inadvertently come loose. It also would be desirable to have a solution to this problem.

In addition, there are certain circumstances that do not occur as often in a stud wall, but which present unusual problems for a mass-produced bridging member. For example, at a door jamb, where the studs generally are doubled up, typical mass-produced bridging members are not readily attachable to both of the studs.

Furthermore, it would be desirable to have a bracket for attaching an end of a bridging member against a flat surface. Another situation that occurs is an irregular stud spacing that does not readily accommodate and/or further complicates the installation of a bridging member. Accordingly, it would be desirable to have a system for quickly and easily installing a bridging member across irregularly spaced studs.

SUMMARY OF THE INVENTION

One embodiment of the present invention provides a bridging/spacing member having an inverted V-shape cross section with an overall width approximately equal to the width of the stud punch-outs for conduits, and a bracket having a generally similar cross-section attachable to the bridging/spacing member at any point. The bracket has a greater width with notches cut in distal ends thereof for engaging the web of a stud.

Another embodiment of the present invention also provides an angled clip having a first portion with a cross-section generally similar to the cross section of the bridging/spacing member and a second portion lying in a plate extending approximately at a right angle to the first portion for attachment to the face of a wall or stud without passing through a conduit punch-out. The present invention may also provide a jamb connector for engaging the webs of two adjacent metal studs and for connection to bridging/spacing members on either side. The present invention may also include a hold down bracket attachable above a bridging/spacing member across a conduit punch-out to prevent removal of the bridging/spacing member.

Still another embodiment of the present invention comprises a stud bridging/spacing member for the quick and easy spacing of a plurality of studs without measuring, while at the same time providing bridging between the studs. In this embodiment, the bridging function of the stud bridging/spacing member reinforces the studs to resist bending under axial loads and to resist rotation under transverse loads, providing a "shear" connection between the bridging/spacing member and the studs. The stud bridging/spacing member enables a substantial reduction in the amount of time needed to install a metal stud wall and, in particular, a load bearing wall, while at the same time functioning effectively to lock each stud against bowing, twisting or turning when subject to axial, transverse and/or lateral loads, thereby providing improved strength and rigidity to the metal stud wall.

Another embodiment of the invention comprises a metal stud wall including the stud bridging/spacing member and a method of assembling a metal stud wall using the stud bridging/spacing member. The angled slots, or more accurately the angled sides thereof, coact with the webs of the studs and may inhibit twisting, turning or bowing of the studs when subjected to axial and/or lateral and/or transverse loads. Moreover, as the loads increase, the angled slots can more tightly lock with the stud webs by providing the "shear" connecting between the bridging/spacing member and the webs of the studs.

According to one aspect of an embodiment of the invention, a stud bridging/spacing member includes an elongate member having at least three longitudinally spaced apart notches for receiving and engaging therein a web of a metal stud. The notches extend at an incline to the longitudinal axis of the elongate member to accommodate different gauges of metal studs while maintaining on-center spacing of studs when assembled in a stud wall.

According to one embodiment of the invention, the notches extend inwardly at an angle of about two to about fifteen degrees relative to a perpendicular to the longitudinal axis, and more preferably about five and a half degrees to about eight degrees, and most preferably about seven degrees. The notches have a width of about 0.050 inch (about 0.13 cm) to about 0.1 inch (about 0.2 cm), more preferably about 0.065 inch (about 0.16 cm) to about 0.080 inch (about 0.20 cm), and most preferably about 0.080 inch (about 0.20 cm). The elongate member is formed of fourteen, sixteen or eighteen gauge metal such as, for example, steel or galvanized steel).

In this embodiment, the at least three notches generally extend laterally inwardly from laterally outer edges of the elongate member. The elongate member may include a fourth notch equally spaced between at least two of the at least three notches. Each of the at least three notches in one portion of the elongate member may be laterally aligned with a corresponding notch in another portion of the elongate member, and/or the laterally aligned notches may incline in the same direction. The sides of the notches generally are parallel, and straight.

Further in accordance with an embodiment of the present invention, the elongate member has a V-shape lateral cross-section formed by longitudinally extending planar first and second portions joined at respective longitudinal edges to form the sides and vertex of the V-shape. The elongate member further may include a pair of wing portions extending laterally outwardly from respective distal ends of the V-shape elongate member. The wing portions may extend in opposite directions from the V-shape elongate member, and each wing portion may extend a distance which is approximately one-third the width of the widest part of the V-shape elongate member. The angle of the V is of least about 90°, more preferably at least about 120° and most preferably about 130°. A shallow angle increases the transverse stiffness of the elongate member, although other means may be used for this purpose.

According to another aspect of one embodiment of the present invention, a metal stud wall includes at least three metal studs each having at least two flanges interconnected by a web. The web of each stud has an opening, and the studs are arranged in a row with the openings in the webs thereof aligned with one another. An elongate member as described above extends through the openings of the at least three studs, and the at least three longitudinally spaced apart notches engage the webs of the studs. The notches generally are equally longitudinally spaced apart at a predetermined web-to-web spacing of the studs. The web-to-web spacing may be, for example, sixteen inches (about 40.6 cm) or twenty-four inches (about 61.0 cm). The metal stud wall typically will include one or more additional elongate members with adjacent ends overlapping and engage with respect to a common stud.

In assembling a metal stud wall including a row of metal studs each having at least two flanges, interconnected by a web, each stud is fastened at a lower end to a base track. A stud bridging/spacing member is inserted through aligned openings in at least three metal studs, and longitudinally-spaced apart notches in the stud bridging/spacing member are engaged with respective webs of the metal studs, thereby establishing and maintaining a fixed spacing between the metal studs and reinforcing the studs against deflection and turning under loading. When the notches engage the webs of the studs, a portion of the webs of the studs generally is caused to bend (at least under load conditions) in the direction of the inclines of the notches to retain the web in the engaged notch. The assembly method may also include securing a top end of each of the studs to a ceiling track.

The foregoing and other features of the invention are hereinafter fully described and particularly pointed out in the claims, the following description and the annexed drawings setting forth in detail certain illustrative embodiments of the invention, these being indicative, however of but a few of the various ways in which the principles of the invention may be employed.

BRIEF DESCRIPTION OF THE DRAWINGS

FIG. 1 is a perspective view of a metal stud wall including a stud bridging/spacing member according to one embodiment of the present invention.

FIG. 2 is an elevational end view of a stud showing one stud bridging/spacing member embodiment disposed in an opening in a metal stud of the wall.

FIG. 3 is a perspective view of one stud bridging/spacing member embodiment, showing the notch in the bridging/spacing member.

FIG. 4 is an elevational end view of a stud showing the stud bridging/spacing member disposed in another type of opening in a metal stud.

DETAILED DECRIPTION OF EMBODIMENTS OF THE INVENTION

Figure 5:
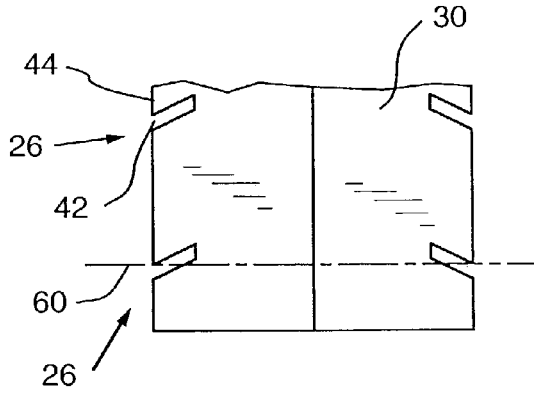
FIG. 5 is a top view of one stud bridging/spacing member embodiment.

FIG. 1 illustrates the skeleton of a metal stud wall 10 according to one embodiment of the present invention. In this embodiment, the metal stud wall 10 generally comprises a base track 12, a plurality of metal studs 14 disposed in a row, at least one bridging/spacing member 16, and wall panels (not shown). The wall panels, such as wall board, may be secured in a well known manner to one or both sides of the metal studs to close the wall and to form the exterior surface or surfaces of the wall. Alternatively, one or both sides of the metal studs may be faced with masonry, such as a brick wall facing on an exterior side of a curtain wall.

The studs 14, as illustrated in FIG. 1, are generally C-shaped, as is conventional. The studs 14 have a web 18 and a pair of L-shape flanges 20 perpendicular to the web 18. There is also one or more openings 22 in the web 18. The openings 22 heretofore have been provided in metal studs to permit bridging members, electrical conduit and/or plumbing to be run within the stud wall. Since the openings 22 are located in the same position in the individual studs forming the wall as is conventional, the openings 22 are horizontally aligned with each other as shown in FIG. 1. Note that the particular openings 22 shown in FIGS. 1 and 2 are generally found in non-load bearing walls.

Although in the illustrated stud wall 10 the stud bridging/spacing member 16 engages the webs 18 of the studs 14 adjacent the base of the upper rectangular portion of the opening 22, alternatively the stud bridging/spacing member 16 may be dimensioned to engage the webs of the studs adjacent the base of the lower rectangular portion of the opening 22. The larger stud bridging/spacing member may provide more resistance to loading on the studs, however, it also may restrict the ability to run electrical conduit and/or plumbing through the opening 22. Thus, since this type of opening 22 is generally used in non-load bearing stud walls which are subject to smaller loads, the smaller stud/bridging member may be used. However, the stud bridging/spacing member 16 may be used in load bearing stud walls, wherein the studs generally have a different type of opening, as hereinbelow is further explained.

In the assembly of the metal stud wall 10 of this embodiment, the metal studs 14 are secured at their lower ends to the base track 12 by fastening means 24, such as screws, rivets, etc. The base track 12 is an U-shape channel having a central planar strip with upstanding legs at lateral sides thereof. The studs forming the wall are secured by the fastening means 24 to the upstanding legs of the base track 12 that normally will be anchored to the floor. The metal studs extend into a ceiling track (not shown) which is similar to the base track 12, except that it is secured to (or has secured thereto) overhead joists which may form the framework for an upper floor.

The stud bridging/spacing member 16 is inserted through the openings 22, and a plurality of "stud engagers" in the form of notches 26 in the stud bridging/spacing member 16 are aligned with the webs 18 of respective studs 14, or vice versa, the notches 26 being designed to engage and to retain the webs 18 of the studs 14 therein. The stud bridging/spacing member 16 is turned and is moved downwardly, as by tapping, to move the webs 18 of the metal studs 14 into engagement with the notches 26. In this manner the stud bridging/spacing member 16 sets the spacing of the studs 14, thus making it unnecessary to manually mark off the stud spacing. As a result, only one stud need be plumbed and secured to surrounding structure, such as at its top to the ceiling track (not shown). With one stud plumbed and fixed in place, all of the other studs will be spaced and held plumb by the bridging/spacing member or chain of overlapping bridging/spacing members without measuring. In an exterior load bearing wall, generally each of the studs also is secured at its upper end to the ceiling track.

The stud bridging/spacing member 16 also functions to rigidly maintain the metal studs 14 at the prescribed spacing, for example, during application of the wall panels (not shown) to the studs. Although the wall panels once applied also will help maintain the spacing of the metal studs, the stud bridging/spacing member 16 resists relative movement of the metal studs in the plane of the wall and resists flexing of the studs. In fact, additional bridging/spacing members 16 may be provided at different heights to further strengthen the metal stud wall 10. Openings 22 in the webs of the studs are usually vertically spaced apart approximately four feet on center in load bearing studs, and thus different sets of bridging/spacing members 16 may be similarly vertically spaced.

As illustrated in FIG. 1, in this embodiment, each stud bridging/spacing member 16 spans at least three metal studs 14, although longer bridging/spacing members may be used, if desired, to span four, five or more studs, or even shorter bridging/spacing members spanning only two studs may be employed. When forming a wall system having a number of metal studs spaced apart to exceed the length of a single stud bridging/spacing member 16, a plurality of stud bridging/spacing members 16 may be used in an end-to-end relationship with relatively adjacent ends overlapped and secured to at least one common stud 14 so as to maintain the continuity of the stud bridging/spacing members 16 over the length of the stud wall 10.

Referring now to FIGS. 2–5, one embodiment of stud bridging/spacing member 16 can be seen to include a bar-like elongate member 30 which is generally V-shape in cross-section along its length. The V-shape functions to rigidify the elongate member 30 against lateral flexure, i.e., flexure perpendicular to the longitudinal axis of the bridging/spacing member.

In this embodiment, the overall length of the stud bridging/spacing member 16 is about fifty inches (127 cm). The bridging/spacing member 16 is sufficiently narrow in at least one dimension to fit within the dimensions of the openings 22 in the webs 18. The type of conduit opening 22 shown in FIG. 2 is typically about one inch (about 2.5 cm) wide in its lower region. In this embodiment, the width of the bridging/spacing member 16 is approximately two and one quarter inches (about 5.7 cm) when oriented as shown in FIG. 2 (i.e., from outer edge to outer edge), and the vertex of the V is about half an inch (about 1.3 cm) from a plane which contains the distal ends of the legs of the V. Accordingly, the bridging/spacing member 16 generally has an included angle greater than 90° and less than 180°, and more preferably has an included angle of about 132°. It has been found that generally a shallower angle (wider space between the distal ends of the legs) provides more resistance to deflection under lateral loads, whereas a deeper angle (narrower space between the distal ends of the legs) may provide more resistance to deflection under compression loads (axial loads on the studs 14, see FIG. 1). However, since the bridging/spacing member 16 is more likely to be subject to lateral loads since the studs 14 (FIG. 1) support the vertical loads axially, a shallower included angle may be used.

In this embodiment, the metal that forms the stud bridging/spacing member 16 has a thickness ranging, for example, from about twenty gauge (about 0.034 inch (about 0.086 cm)) to about fourteen gauge (about 0.071 inch (about 0.18 cm)). The stud bridging/spacing member 16 is constructed from about sixteen gauge metal, which has a thickness of about 0.058 inch (about 0.15 cm). Eighteen gauge metal has a thickness of about 0.045 inch (about 0.11 cm). Those of ordinary skill in the art will, of course, appreciate that the thickness of the material employed to fabricate the stud bridging/spacing member may be adapted to accommodate the specific structural loading that the wall is expected to encounter.

The elongate member 30 need not necessarily have a V-shape as shown in FIG. 3. The elongate member 30 alternatively could be generally planar with one or more bosses running (and overlapping if plural bosses are provided) the length of the elongate member 30. The boss or bosses (deflected out of the planar portions of the elongate member) would serve to rigidify the elongate member 30. Of course, other means may be provided to rigidify the elongate member 30 against lateral flexure, such as the use of stiffening ribs, a thicker stock, etc. In addition, the stud bridging/spacing member 16 may be used with studs 14 having openings 122 as shown in FIG. 4.

Referring to FIG. 3, in this embodiment, each planar side portion of the V-shape elongate member 30 is provided with the plurality of stud engagers in the form of notches 26 which open to the longitudinal or laterally outer edge 32 of the respective side portion. The notches 26 are formed to a depth from the edge of about three-eighths of an inch (about 0.95 cm). Although the notches 26 are shown disposed along the outer edge 32 of each side portion, the notches 26 could be formed elsewhere, although less desirably, such as along the vertex (crease) 40 of the V-shape elongate member 30.

The notches 26 of one side portion are laterally aligned with corresponding notches of the other side portion. The pairs of laterally aligned notches 26, as opposed to a single notch, provide two areas of contact with the web 18 of a stud 14 (see FIGS. 1 and 2). The two areas of contact enhance the grip of the bridging/spacing member 16 on the webs 18 of the studs 14 and aid in preventing the studs 14 from pivoting or twisting, thus adding greater stability to the wall 10 (see FIG. 1).

Referring now to FIGS. 3 and 5, each notch 26 is formed by a slot 38 inclined relative to the longitudinal axis of the stud bridging/spacing member 16, wherein the angle and the width of the slot 38 cooperate to bind the webs 18 of the studs 14 in the notches 26 (see FIG. 1). The slot 38 may have a width of about 0.065 inch (about 0.16 cm) to about 0.080 inch (about 0.20 cm), and may be angled about five and a half degrees to about eight degrees relative to a perpendicular 60 to the longitudinal axis of the bridging/spacing member 16. More preferably, the slot 38 is angled about seven degrees and has a width of about 0.080 inch (about 0.20 cm). The slot 38 generally has parallel sides that are straight. However, other configurations are contemplated. For example, the slot 38 may have curved parallel sides.

As indicated above, this embodiment of the stud bridging/spacing member 16 is made of eighteen to fourteen gauge metal. The width and angle provide notches 26 which have been found to fit twenty gauge studs 14 (FIG. 1), to fit eighteen gauge studs 14 with a slight bind, and to fit sixteen gauge studs 14 tightly, which may cause the webs 18 (FIG. 1) of the studs 14 to bend slightly with the notch 26. The notches 26 have also been found to fit fourteen gauge studs 14, with a tight fit. The tighter fit with heavier gauge studs is desired as usually they are used to bear higher loads.

Figure 6:
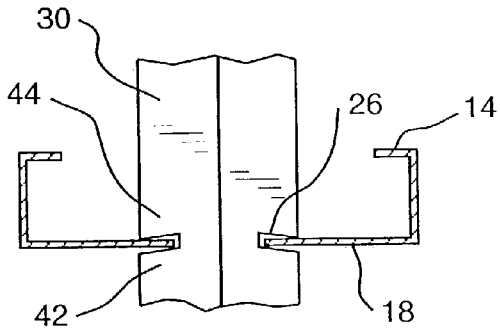
FIG. 6 is a top view of the stud and the stud bridging/spacing member as seen along line VI—VI of FIG. 2.

As shown in FIGS. 5 and 6, the sides of the angled notch 26 form angled shoulders in adjacent portions of the elongate member 30, one of which forms an abutment 42 against which the web 18 of the stud 14 is urged, and the other of which forms a barb 44 which can "bite" into the web 18 of the stud 14 and about which the web 18 of the stud 14 may deform as the web 18 is inserted into the notch 26. The angle and the width of the slot 38 cooperate to bind the web 18 of the stud 14 in the slot at least when subjected to loads that would tend to cause the elongate member to become dislodged. The bind forces a portion of the web 18 to bend with the angle of the slot 38. However, generally neither the barb 44 nor the abutment 42 move out of the plane of the planar portion of the elongate member 30.

Installation of the bridging/spacing member 16 causes the webs 18 of the studs 14 to be urged against the abutments 42 to place the studs "on center" against the opposing wall of the slot, i.e., the barb 44 urges the web 18 against the abutment 42. The distance between the cuts that form the abutments 42 can be controlled within tight tolerances and this translates to accurate spacing of the studs in a row thereof forming a wall.

For example, in the United States, stud walls are generally constructed with studs spaced on sixteen or twenty-four inch (about 40.6 cm to 61.0 cm) centers. Therefore, a cut in the elongate member 30 will be made at sixteen or twenty-four inch (about 40.6 cm to 61.0 cm) intervals, thus ensuring that the web to web spacing of the studs 14 will be sixteen or twenty-four inches (about 40.6 cm to 61.0 cm).

Figure 7:
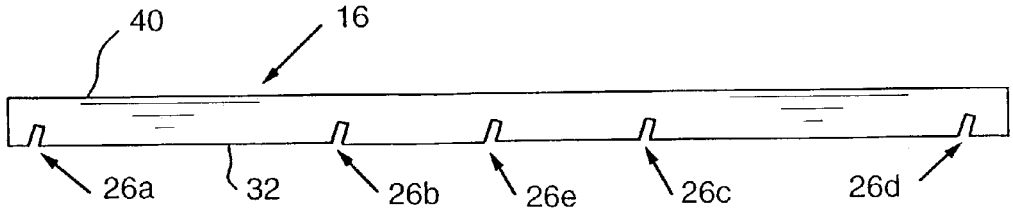
FIG. 7 is a side view of the stud bridging/spacing member showing one spacing of the notches.

As illustrated in FIG. 7, the stud bridging/spacing member 16 includes four notches 26*a*–26*d* spaced at sixteen (about 40.6 cm) intervals, and one notch 26*e* equally spaced between the two central notches 26*b* and 26*c*. This particular arrangement of notches 26 creates a stud, bridging/spacing member 16 which can be used in metal stud walls 10 (FIG. 1) which have a stud spacing of either sixteen or twenty-four inches (about 40.6 cm to 61.0 cm). If the wall 10 is to have a stud spacing of sixteen inches (about 40.6 cm), notches 26*a*–26*d* engage the webs 18 of the studs 14 (see FIG. 1). If the wall 10 is to have a stud spacing of twenty-four inches (about 61.0 cm), notches 26*a*, 26*d*, and 26*e* engage the webs 18 of the studs 14. Since the overall length of the stud bridging/spacing member 16 is about fifty inches (about 127 cm), this leaves about one inch (about 2.5 cm) outside the outermost notches.

An embodiment of the bridging/spacing member 16 having the slanted notch 26 described above has been found to provide improved strength to the metal stud wall 10 (FIG. 1) under loads far in excess of those required by most building codes for load bearing walls. The present invention provides a bridging/spacing member that rigidly connects the studs in a stud wall, unlike some prior spacing members which allow the framing system to flex in length to accommodate the attachment of wall panels wrapped in a heavy wall covering. In addition, unlike prior bridging systems, installation of the stud bridging/spacing member having the slanted notches does not require fasteners and yet resists deformation and turning of the studs under load. For example, under extreme lateral loading conditions, the bridging/spacing member of the present invention has been found to fail only by shearing through the webs of the studs at forces far higher than those at which other bridging systems failed by breaking their fasteners. Accordingly, the bridging/spacing member 16 can be quickly and easily installed, simultaneously spacing and reinforcing the metal studs in a stud wall.

Figure 9:
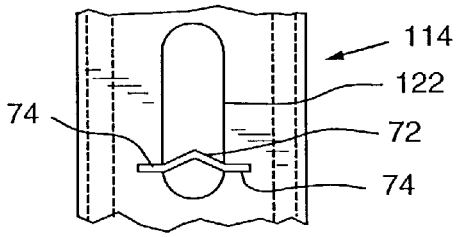
FIG. 9 is an elevational view of a stud showing the stud bridging/spacing member of FIG. 8 disposed in an opening in a metal stud of the wall.
Figure 8:
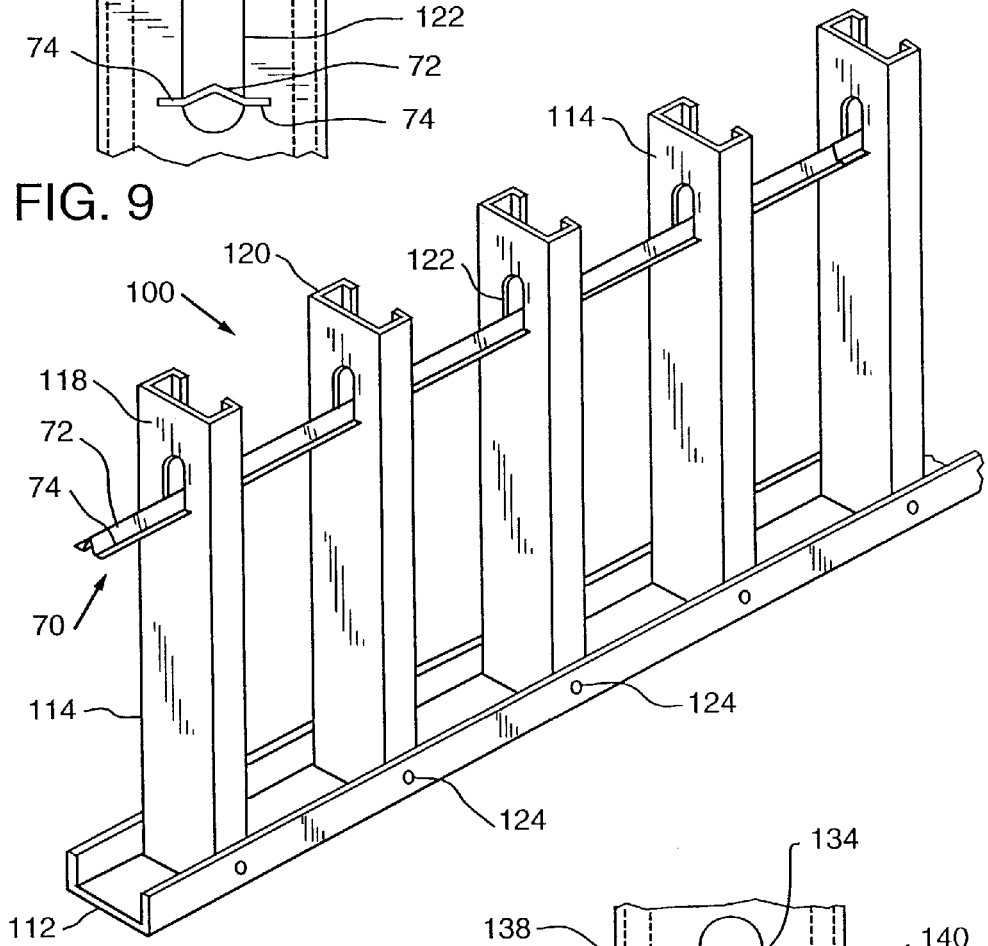
FIG. 8 is a perspective view of a metal stud wall including another stud bridging/spacing member according to the present invention.

An alternative stud bridging/spacing member 70 is shown in FIGS. 8 and 9. In this embodiment, the stud bridging/spacing member 70 has a central portion 72 similar to the V-shape of the stud bridging/spacing member 16 described above (see FIG. 2), with a pair of laterally extending wing portions 74 extending outwardly from distal ends of the V-shape central portion 72. The wing portions 74 extend a distance equal to about one-third of the width of the central portion 72. The wing portions 74 extend in opposite directions in a common plane, however, the wing portions 74 may extend in different planes. The stud bridging/spacing member 70 has at least three longitudinally spaced pairs of transversely aligned notches 76 of the type described above. The notches may extend only through the wing portions 74 or may also extend into the V-shape central portion 72.

The stud bridging/spacing member 70 can be installed in a stud wall 100 in the same way as the stud bridging/spacing member 16 is installed in the stud wall 10 in FIG. 1. The stud wall 100 includes a plurality of studs 114, each stud 114 having a web 118 and a pair of L-shape flanges 120 perpendicular to the web 118, with at least one opening 122 in the web 118. Unlike the opening 22 shown in FIGS. 1 and 2, the opening 122 has a uniform width central portion and rounded end portions. This type of opening 122 is more common in load bearing studs. Another type of opening (not shown) is similar but has, pointed ends. The stud bridging/spacing member 70 is not limited to any form of opening, however.

The studs 114 are secured at their lower ends to the base track 112 by fastening means 124 in the same manner as described above with reference to FIG. 1. The stud bridging/spacing member is inserted through the openings 122 and the notches 76 are aligned with the webs 118 of the studs 114. The bridging spacing member 70 may be rotated and is then moved down over the webs 118 of the studs 114 to engage the lower end of the central portion of the opening 122 as shown in FIG. 9. Additional bridging/spacing members 70 overlap adjacent ends of preceding bridging/spacing members 70 as needed to provide continuous bridging between all of the studs 114 in the wall 100. The upper ends of the studs 114 may then be connected to a ceiling track (not shown) as required.

The addition of the wing portions 74 facilitates installation by making it easier to "eyeball" the stud bridging/spacing member 70 to make sure it is level and thus firmly seated in each opening 122 in the webs 118 of the studs 114. This feature helps to improve the speed and quality of the installation process. In addition, the wing portions 74 further rigidify the stud bridging/spacing member 70 against transverse loads on the wall 100, which may be particularly advantageous, for example, in external walls in building locations subject to high wind loads.

The Applicant has found that the bridging system and method described herein performs approximately as well as or better than several more labor-intensive (and therefore generally more expensive) bridging systems under different types of loads. As a result, the system and method of the present invention provide approximately the same structural strength, while the spacing function of the bridging/spacing member helps to greatly reduce installation time, thereby providing substantial cost savings.

Figure 10:
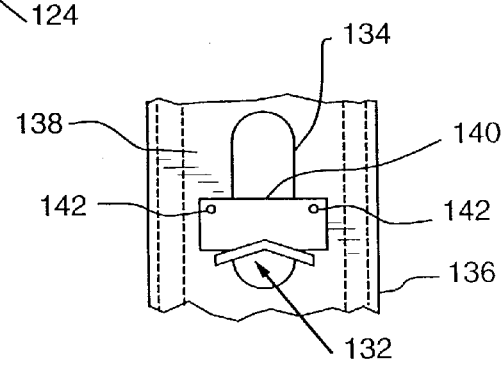
FIG. 10 is an elevational view of a stud showing the bridging/spacing member of FIG. 4 disposed in the opening with a bar guard.
Figure 11:
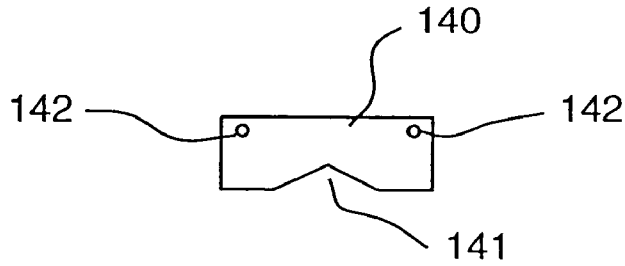
FIG. 11 is an elevational view of a bar guard embodiment.

As shown in FIGS. 10 and 11, the system and method of the present invention may also include a bar guard to minimize or prevent other building tradespeople from inadvertently removing the bridging/spacing member 132 from the conduit opening 134 in the stud 136. The bar guard may include a screw driven through the web 138 of the stud to prevent the bridging/spacing member from being lifted out, or a metal plate, such as the illustrated plate 140, attached to the web of the stud above the bridging/spacing member. The illustrated bar guard 140 of this embodiment has a notch 141 at a lower end to closely engage the top of the bridging/spacing member and a pair of holes 142 near an upper edge for fastening the bar guard to the web of the stud with screws. Although other methods of attaching the bar guard to the stud could be used, the holes 142 generally are laterally spaced apart a distance greater than the width of the conduit punch-out so that the screws or other fasteners may pass through those holes into the web of the stud. Since the bridging/spacing member spans at least three studs, the bar guard does not have to be attached to every stud. Thus, installation of the bridging/spacing member with the bar guard remains much quicker than conventional methods.

Figure 12:
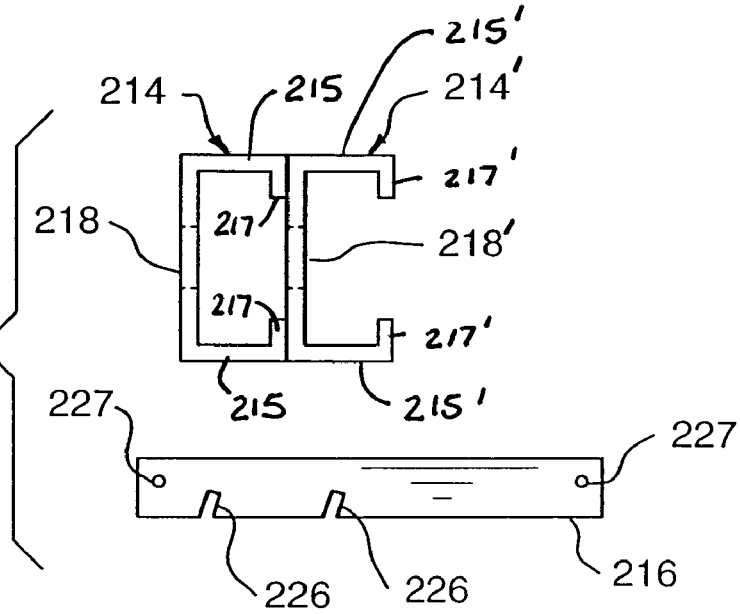
FIG. 12 is a top view of a pair of jamb studs placed against one another and a side view of a jamb connector showing the alignment of notches in the jamb connector relative to the webs of the jamb studs.
Figure 13:
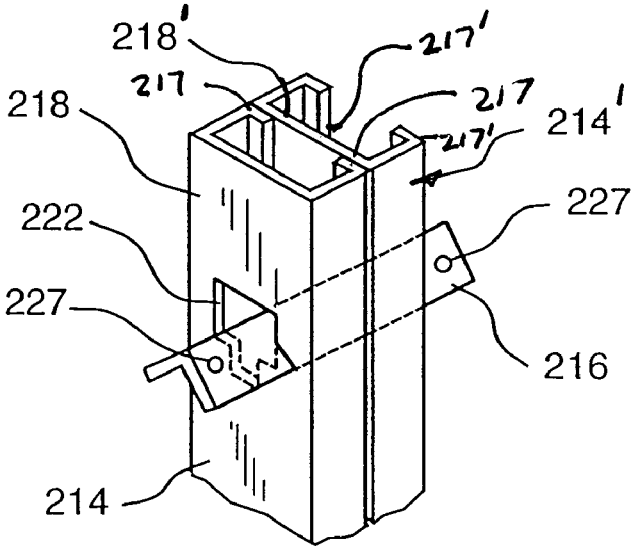
FIG. 13 is a partial perspective view of the jamb connector and jamb studs of FIG. 12.
Figure 14:
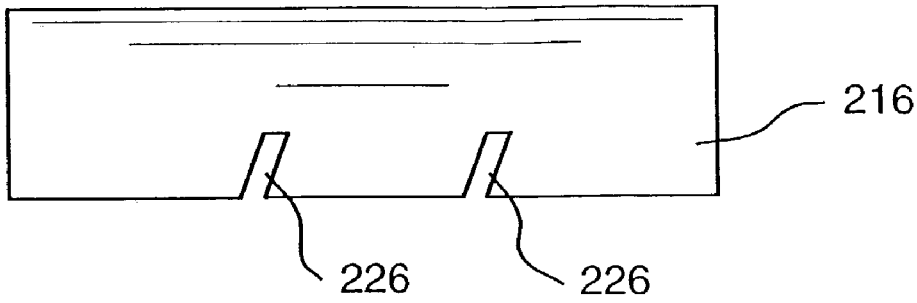
FIG. 14 is a side view of an alternative jamb connector.
Figure 15:
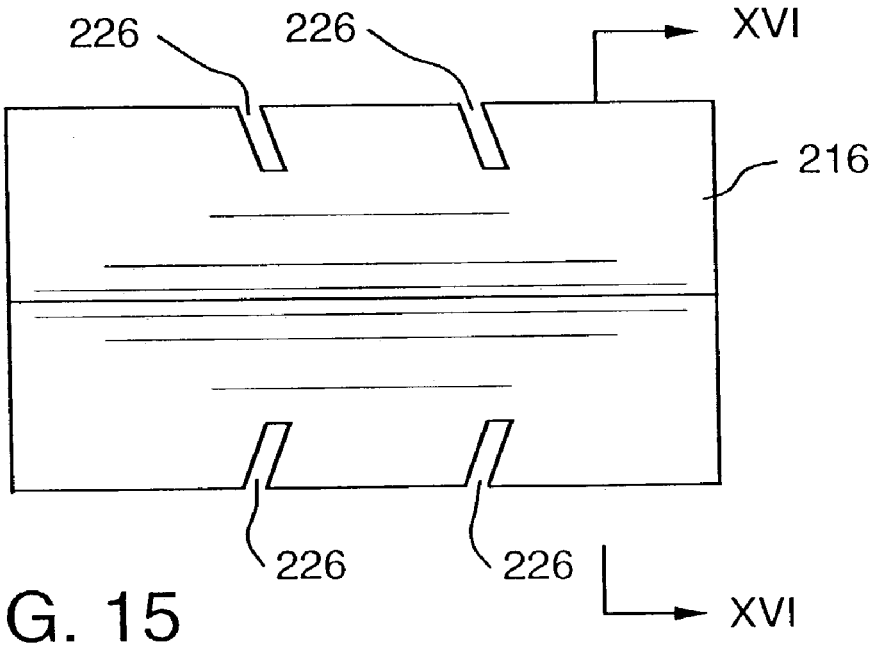
FIG. 15 is a top view of the jamb connector of FIG. 14.
Figure 16:
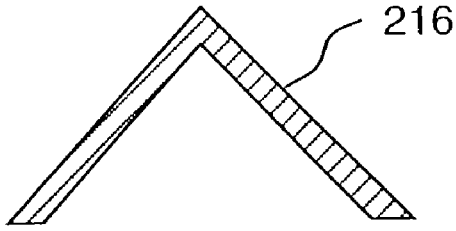
FIG. 16 is a cross-sectional view of the jamb connector of FIGS. 14 and 15 taken along line XVI—XVI in FIG. 15.

As shown in FIGS. 12 and 13, in the situation such as a door jamb or window where two studs 214 are butted up against one another, the webs 218 of the studs 214 are oriented very close to one another, thereby making it more difficult for a stud bridging/spacing member of the types described above to engage both webs 218. As can be seen in those Figures, a door jamb or window jamb embodiment may be formed from a first stud 214 that has a first web 218 with at least one opening 222 therethrough. The first stud has a pair of first flanges 215 that each have a first leg 217 extending therefrom. This embodiment also includes a second stud 214' that has a second web 218' with at least one second opening 222' therethrough. The second stud has a pair of second flanges 215' that each have a leg 217' extending therefrom. As shown in FIGS. 12 and 13, the first stud 214 is oriented relative to the second stud 214' such that the first legs 217 are in abutting contact with the second web 218' of the second stud 214' and at least one first opening 222 is aligned with a second opening 222' to receive a jamb connector 216 therethrough. As seen in FIG. 12, the jamb connector 216 includes two closely spaced sets of notches 226 for engaging the first web 218 and the second web 218' of the first stud 214 and the second stud 214', respectively to form the jamb. The jamb connector 216 is passed through the aligned openings (222, 222') in the webs (218, 218') of the studs (214, 214') and moved downwardly to engage the webs (218, 218') of the studs (214, 214') in the notches as described above with respect to the bridging/spacing member 30 (FIG. 1.) The embodiment shown in FIGS. 12 and 13 may have holes 227 near the ends thereof for driving screws or other fasteners (not shown) therethrough for connection to adjacent bridging/spacing members. Alternatively, as shown in FIGS. 14–16, these holes 227 may be omitted. In this situation, either the holes 227 may be produced after jamb connector 216 is installed, or they may be omitted entirely, in which case a bridging/spacing member may pass through just one of the jamb studs 214 to continue the bridging to the next stud 214.

Figure 17:
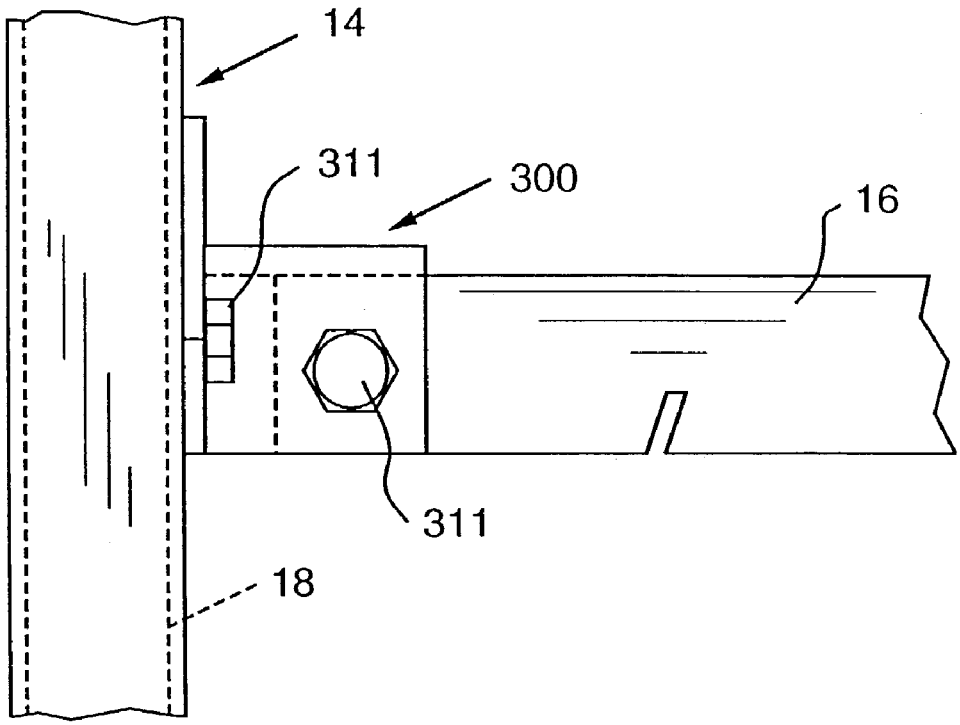
FIG. 17 is a partial schematic view of a face bracket mounted to the web of a stud and an end of a bridging/spacing member.
Figure 18:
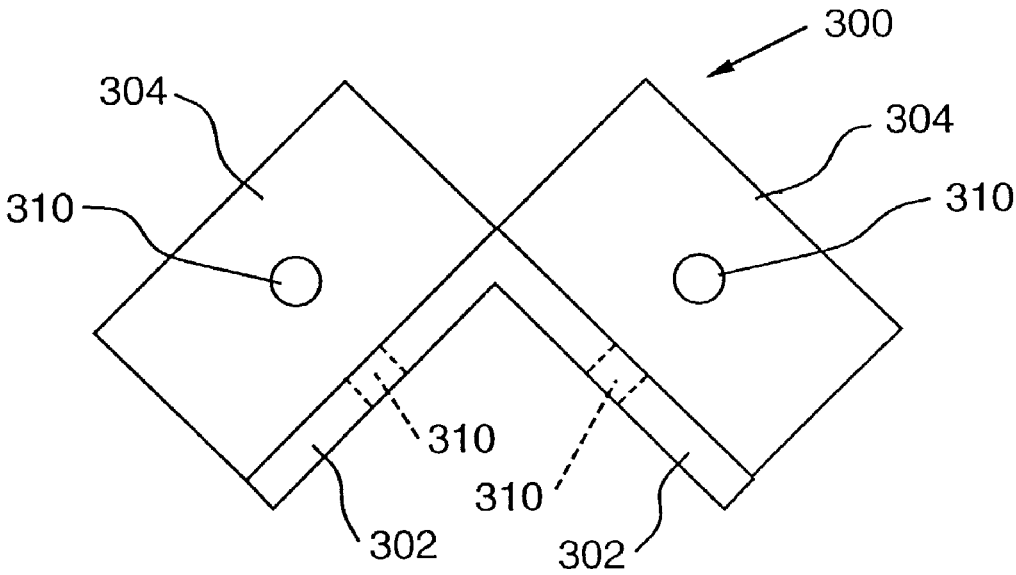
FIG. 18 is a front view of the face bracket of FIG. 17.
Figure 19:
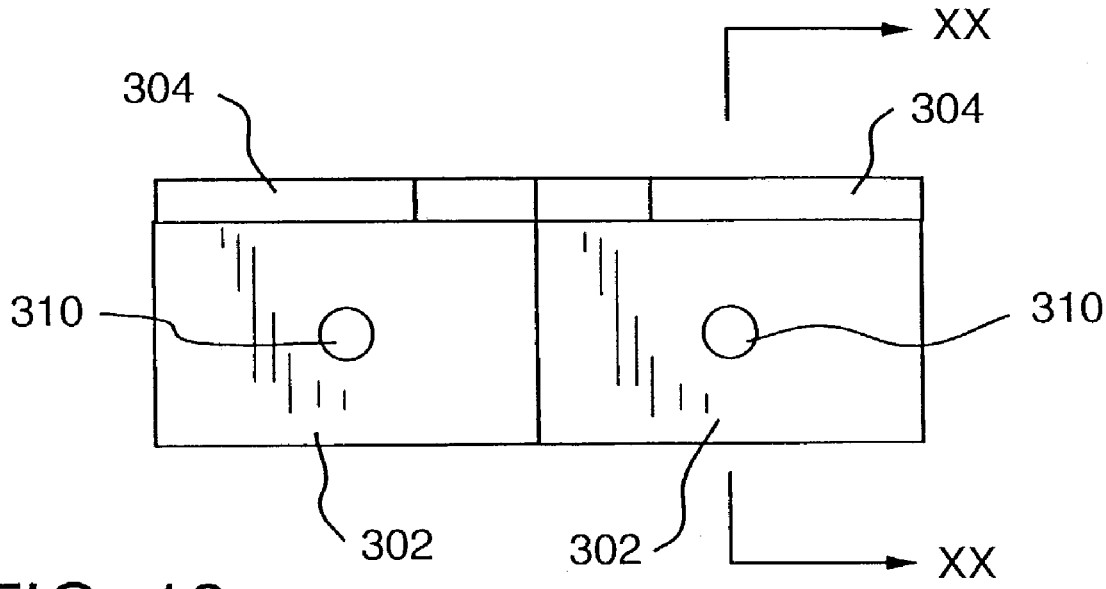
FIG. 19 is a top view of the face bracket of FIGS. 17 and 18.
Figure 20:
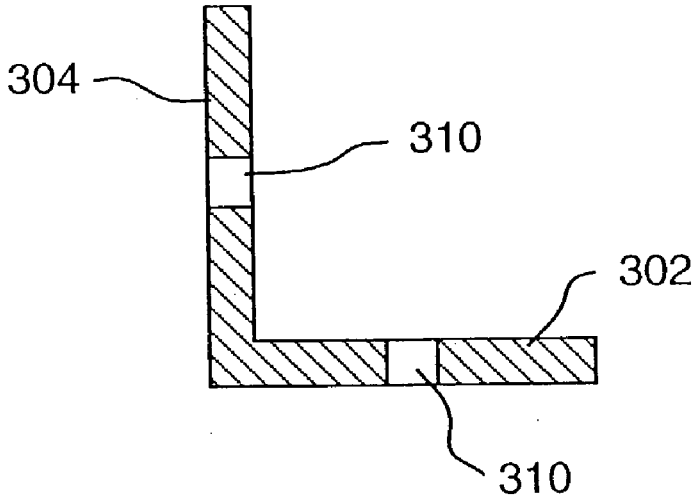
FIG. 20 is a cross-sectional view of the face bracket taken along line XX—XX in FIG. 19.

In situations where the bridging/spacing member is short of a stud or for other reasons it would be difficult to mount the bridging/spacing member in the conduit punch-out, a face bracket 300 may be used to attach the spacing member 16 to the web 18 of the stud 14 without passing through the conduit punch-out. As shown in FIG. 17, the face bracket 300 can be used as a hold-down bracket and mounts above the bridging/spacing member 16. However, the face bracket 300 could also support the bridging/spacing member 16 from below. One embodiment of the face bracket 300 is shown in FIGS. 18–20. As can be seen on those Figures, the face bracket 300 has first portions 302 which are angled to approximate the cross-sectional shape of the bridging/spacing member 16 and second portions 304 which extend approximately at right angles thereto and lie in a common plane for attachment to the face or web 18 of a stud 14 or wall as the case may be. Each portion 302, 304 of the face bracket 300 may have an opening 310 therein for passing a fastener 311 therethrough. In one embodiment, the first portions are approximately 1.5 inches (38 mm) long and the opening 310 may be centrally located therein. The underlying bridging/spacing member 16 may be predrilled, may be drilled on site, or self-attaching fasteners, such as self-threading sheet metal screws may be used. Those of ordinary skill in the art will appreciate, for example, that the face bracket 300 may be fabricated from a piece of 16 gauge angle with 1.5 inch (38 mm) long legs.

Figure 21:
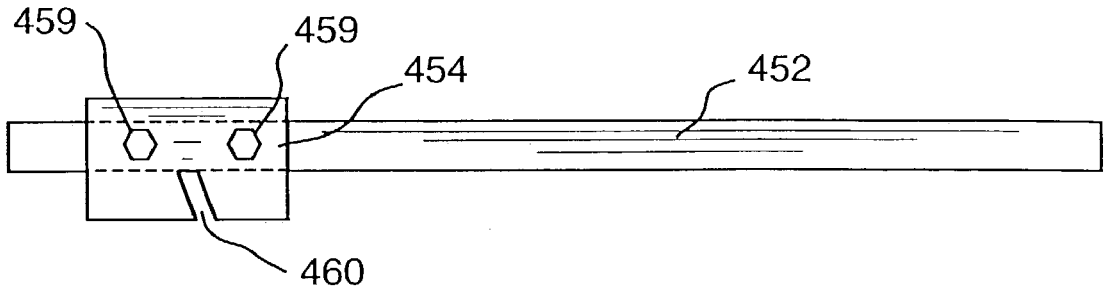
FIG. 21 is a side view of a bridging/spacing member and a bracket constructed for attachment to irregularly spaced studs.
Figure 23:
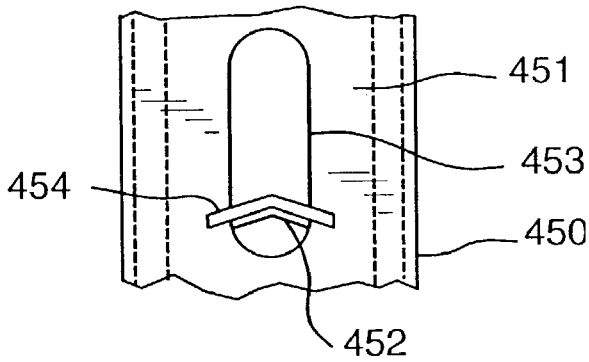
FIG. 23 is a partial view of a stud with the bridging/spacing member and bracket of FIG. 22 attached thereto.
Figure 24:
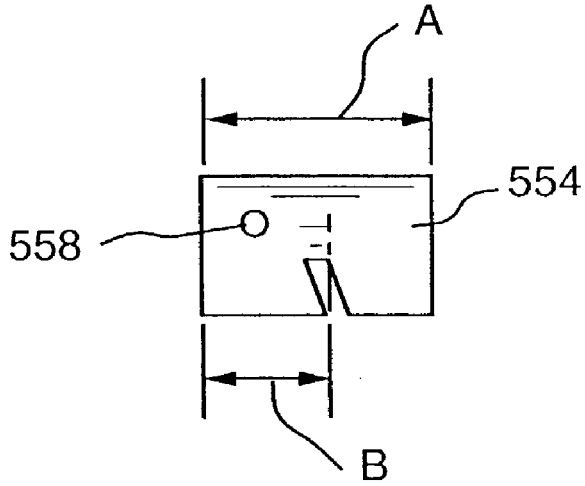
FIG. 24 is a side view of an alternative bracket for use in connection with the bridging/spacer member of FIGS. 21–23.
Figure 25:
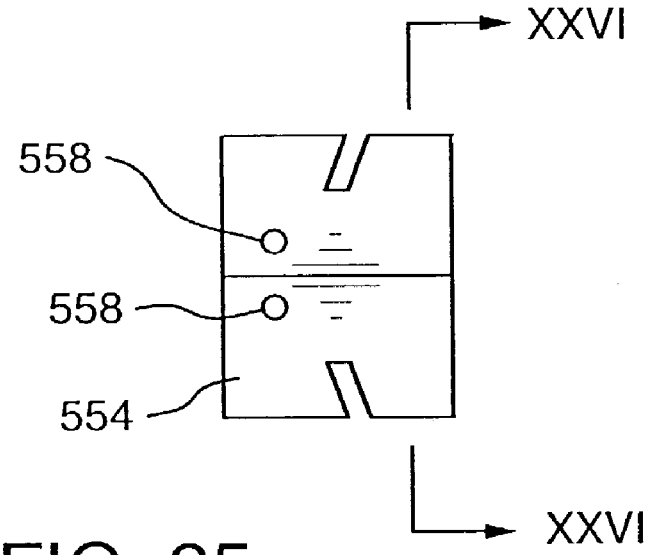
FIG. 25 is a top view of the bracket of FIG. 24.
Figure 26:
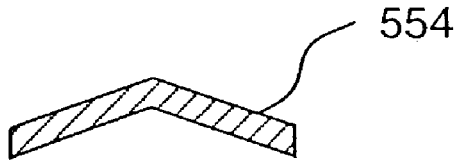
FIG. 26 is a cross-sectional view of the bracket of FIG. 25 taken along line XXVI—XXVI of FIG. 25.

As shown in FIGS. 21, a system for bridging/spacing studs which may or may not be irregularly spaced is shown. Through each stud 450 having a standard conduit punch-out 453 a stud bridging/spacing member 452 passes therethrough and has a width approximately equal to the width of the conduit opening 453. See FIG. 23. A bracket 454 is mounted adjacent of the bridging/spacing member 452 and has a pair of notches 460 therein for engaging the web 451 of the stud 450. A set of holes 458 in the bracket 454 may be used to attach the bracket 454 to the bridging/spacing member 452 with fasteners 459. Since the bracket 454 can be attached to the bridging/spacing member 452 at any point along the length of the bridging/spacing member 452, the bridging/spacing member 452 can be securely mounted to the stud 450 regardless of the spacing between the studs 450. As shown in FIGS. 24–26, an alternative bracket 554 is shown having only two openings 558 therein for fasteners to pass therethrough. Self-threading sheet metal screws (not shown) are preferred. However, other fattener and fastener arrangements may be used. In this embodiment, the bracket 554 is approximately 2.5 inches (63.5 mm) long (distance "A") and the notches 560 are approximately 0.75 inches (19 mm) offset from the holes 558.

Figure 22:
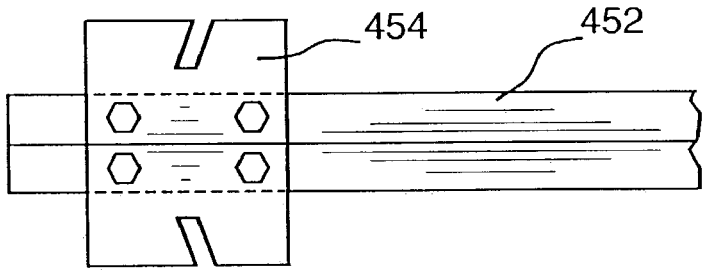
FIG. 22 is a top view of the bridging/spacer member and bracket of FIG. 21.
Figure 27:
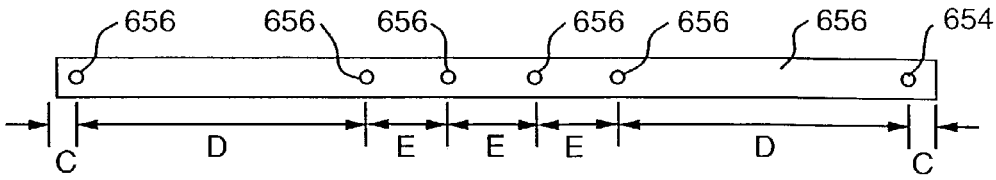
FIG. 27 is a side view of an alternative bridging/spacing member of the present invention.
Figure 28:
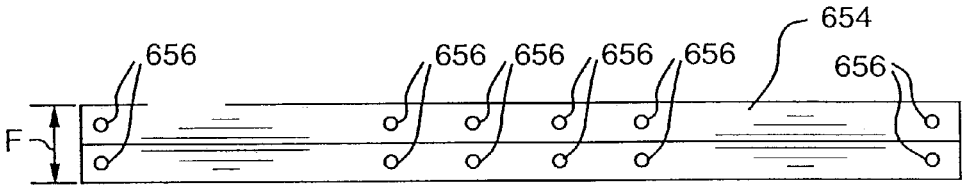
FIG. 28 is a top view of the bridging/spacer member of FIG. 27.
Figure 29:
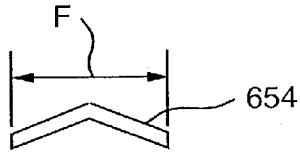
FIG. 29 is an end view of the bridging/spacer member of FIGS. 27 and 28.

An alternative bridging/spacing member 654 is shown in FIGS. 27–29. The only difference between the bridging/spacing member 654 shown in FIGS. 26–28 and the bridging/spacing member 452 shown in FIGS. 21–23 is that the bridging/spacing member 654 has been predrilled with holes 656 at typical stud spacing distances. For example, distance "C" may be one inch (25.4 mm), distance "D" may be 16 inches (406 mm) and distance "E" may be 8 inches (203 mm). Also in this embodiment, the bridging/spacing member 654 is approximately 1.5 inches (38 mm) wide (distance "F" in FIG. 28). As a result, such a bridging/spacing member 654 may be more quickly mounted in a series of regularly spaced studs.

Although the invention has been shown and described with respect to a certain embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A support structure comprising:

a first vertically extending stud having at least two flanges connected by a substantially planar first web;

a first opening through said first web of said first stud;

a second vertically extending stud having at least two flanges connected by a second substantially planar web, said second substantially planar web having a second opening therethrough, said second stud oriented relative to said first stud such that said second stud is in abutting contact with said first stud and said first and second webs are not otherwise directly attached to each other and said second opening is aligned with said first opening;

an elongated connector extending through said first opening and said second opening; and stud engagers in said elongated connector for engaging the first web and said second web to retain said first and second studs in abutting relationship with each other when said elongated connector is inserted into said first opening and said second opening and further moved within said first opening and said second opening in a direction that is substantially parallel to said first web and said second web to bring said stud engagers into engagement with said first web and said second web, said elongated connector rigidly retaining said first and second studs in abutting relationship with each other without use of additional fastening means in contact with said first and second webs.

2. The support structure of claim 1 wherein each said stud engagers comprises a notch in said elongated connector.

3. The support structure of claim 2 wherein said elongated connector has an elongated axis and wherein each said notch extends at an incline to the longitudinal axis of said elongated connector.

4. The support structure of claim 1 wherein said elongated connector has a V-shaped cross-sectional shape.

5. The support structure of claim 1 wherein said elongated connector has two ends and wherein said support structure further comprises at least one fastener hole in at least one said end of said elongated connector.

6. A door jamb comprising:

a first stud having two first flanges connected by a first web, each said first flange having a first leg protruding therefrom;

a first opening through said first web of said first stud;

a second stud having two second flanges connected by a second web, each said second flange having a second leg protruding therefrom;

a second opening through said second web of said second stud, said second opening aligned with said first opening in said first web of said first stud;

an elongated jamb connector extending through said first and second openings; and stud engagers in said elongated jamb connector, wherein at least one stud engager engages said first web of said first stud and wherein at least one other stud engager engages said second web of said second stud to retain said first legs of said first stud in abutting relationship with said second web of said second stud.

7. The door jamb of claim 6 wherein each said stud engager comprises a notch in said elongated jamb connector.

8. The doorjamb of claim 7 wherein said elongated jamb connector has an elongated axis and wherein each said notch extends at an incline to the longitudinal axis of said elongated jamb connector.

9. The door jamb of claim 6 wherein said elongated jamb connector has a V-shaped cross-sectional shape.

10. The door jamb of claim 6 wherein said elongated jamb connector has two ends and wherein said doorjamb further comprises at least one fastener hole in at least one said end of said elongated jamb connector.

11. A door jamb comprising:

a first vertically extending stud having at least two flanges connected by a substantially planar web;

an opening through said web of said first stud;

a second vertically extending stud having at least two flanges connected by another substantially planar web:

another opening through said another web of said second stud, said another opening aligned with said opening in said web of said first stud;

means for spanning through said opening and said another opening; and means for engaging said web of said first stud and said another web of said second stud on said means for spanning to retain said first and second studs in abutting relationship with each other when said means for spanning is inserted into said opening and said another opening and further moved therein in a direction that is substantially parallel to said web of said first stud and said another web of said second stud to bring said means for engaging into engagement with said web of said first stud and said another web of said second stud, such that said first second studs are rigidly retained in abutting relationship with each other without use of additional fastening means in contact with said web of said first stud and said another web of said second stud to form the doorjamb.

12. A method of constructing a doorjamb comprising:

supporting a first stud having a first substantially planar web with at least one first opening therethrough in a vertical orientation;

supporting a second stud having a second substantially planar web with at least one second opening therethrough in abutting relationship with the first stud to form a doorjamb such that at least one of the first openings in the first web of the first stud is aligned with at least one of the second openings in the web of the second stud to form at least one pair of aligned openings, and such that the first and second substantially planar webs are not otherwise directly attached to each other;

inserting a jamb connector through at least one pair of aligned openings; and moving the jamb connector in the pair of aligned openings in a direction that is substantially parallel to said first and second webs to bring portions of said first and second webs into retaining engagement with the jamb connector, such that said first and second studs are rigidly retained in abutting relationship with each other without use of additional fastening means in contact with said first and second webs.

13. A window jamb comprising:

a first vertically extending stud having at least two flanges connected by a substantially planar web;

an opening through said web of said first stud;

a second vertically extending stud having at least two flanges connected by another substantially planar web, said another substantially planar web having another opening, therethrough, said second stud oriented in abutting contact with said first stud such that said web is not directly connected to said another web and said another opening is aligned with said opening in said web of said first stud;

an elongated jamb connector extending through said opening and said another opening; and stud engagers in said elongated jamb connector, wherein at least one stud engager engages said web of said first stud and wherein at least one other stud engager engages said another web of said second stud such that said first and second studs are retained in abutting relationship with each other to form a window jamb when said elongated jamb connector is inserted into said opening of said first stud and said another opening of said second stud and further moved within said opening and said other aligned opening in a direction that is substantially parallel to said web of said first stud and said another web of said second stud to bring said stud engagers into engagement with said web of said first stud and said another web of said second stud, such that said first and second studs are rigidly retained in abutting relationship with each other without use of additional fastening means in contact with said web of said first stud and said another web of said second stud to form the window jamb.

14. The window jamb of claim 13 wherein each said stud engager comprises a notch in said elongated jamb connector.

15. The window jamb of claim 14 wherein said elongated jamb connector has an elongated axis and wherein each said notch extends at an incline to the longitudinal axis of said elongated jamb connector.

16. The window jamb of claim 13 wherein said elongated jamb connector has a V-shaped cross-sectional shape.

17. The window jamb of claim 13 wherein said elongated jamb connector has two ends and wherein said window jamb further comprises at least one fastener hole in at least one said end of said elongated jamb connector.

18. A window jamb comprising:

a first stud having two first flanges connected by a first web, each said first flange having a first leg protruding therefrom;

a first opening through said first web of said first stud;

a second stud having two second flanges connected by a second web, each said second flange having a second leg protruding therefrom;

a second opening through said second web of said second stud, said second opening aligned with said first opening in said first web of said first stud;

an elongated jamb connector extending through said first and second openings; and stud engagers in said elongated jamb connector, wherein at least one stud engager engages said first web of said first stud and wherein at least one other stud engager engages said second web of said second stud to retain said first legs of said first stud in abutting relationship with said second web of said second stud to form a window jamb.

19. The window jamb of claim 18 wherein each said stud engager comprises a notch in said elongated jamb connector.

20. The window jamb of claim 19 wherein said elongated jamb connector has an elongated axis and wherein each said notch extends at an incline to the longitudinal axis of said elongated jamb connector.

21. The window jamb of claim 18 wherein said elongated jamb connector has a V-shaped cross-sectional shape.

22. The window jamb of claim 18 wherein said elongated jamb connector has two ends and wherein said doorjamb further comprises at least one fastener hole in at least one said end of said elongated jamb connector.

23. A window jamb comprising:

a first vertically extending stud having at least two flanges connected by a substantially planar web;

an opening through said web of said first stud;

a second vertically extending stud having at least two flanges connected by another substantially planar web, said another substantially planar web having another opening therethrough, said second stud oriented in abutting contact with said first stud such that said web is not directly connected to said another web and said another opening is aligned with said opening in said web of said first stud;

an opening through said web of said first stud;

means for spanning through said opening and said another opening; and means for engaging said web of said first stud and said another web of said second stud on said means for spanning to retain said first and second studs in abutting relationship with each other to form a window jamb when said means for spanning is inserted into said opening of said first stud and said another opening of said second stud and further moved within said opening and said another opening in a direction that is substantially parallel to said web of said first stud and said another web of said second stud to bring said means for engaging into engagement with said webs of said first and second studs, such that said first and second studs are rigidly retained in abutting relationship with each other without use of additional fastening means in contact with said web of said first stud and said another web of said second stud.

24. A method of constructing a window jamb comprising:

supporting a first stud having a first substantially planar web with at least one first opening therethrough in a vertical orientation;

supporting a second stud having a second substantially planar web with at least one second opening therethrough in abutting relationship with the first stud to form a doorjamb such that at least one of the first openings in the first web of the first stud is aligned with at least one of the second openings in the web of the second stud to form at least one pair of aligned openings and wherein said first and second webs are not directly attached to each other;

inserting a jamb connector through at least one pair of aligned openings; and moving the jamb connector downwardly in the pair of aligned openings to bring portions of said first and second webs into retaining engagement with the jamb connector to form a window jamb, such that said first stud and said second studs are rigidly retained in abutting relationship with each other without use of additional fastening means in contact with said first and second webs.

25. A support structure comprising:

a first member having at least two flanges connected by a substantially planar web;

an opening through said web of said first member;

a second member having at least two flanges connected by a another substantially planar web having another opening therethrough, said second member oriented in abutting contact with said first member such that said web is not directly connected to said another web and said another opening is aligned with said opening in said web of said first member;

an elongated connector having a V-shaped cross-sectional shape and extending through said opening and said another opening; and stud engagers in said elongated connector for engaging the web of said first member and the web of said second member to retain said first and second members in abutting relationship with each other without use of additional fastening means in contact with said web of said first member and said another web of said second member.

26. The support structure of claim 25 wherein each said stud engagers comprises a notch in said elongated connector.

27. The support structure of claim 26 wherein said elongated connector has an elongated axis and wherein each said notch extends at an incline to the longitudinal axis of said elongated connector.

28. The support structure of claim 25 wherein said elongated connector has two ends and wherein said support structure further comprises at least one fastener hole in at least one said end of said elongated connector.

29. A support structure comprising:

a first stud having at least two flanges connected by a web;

an opening through said web of said first stud;

a second stud having at least two flanges connected by a web;

another opening through said web of said second stud, said another opening aligned with said opening in said web of said first stud;

an elongated connector having two ends with at least one fastener hole in at least one of said ends, said elongated connector extending through said opening and said another opening; and stud engagers in said elongated connector for engaging the webs of said first and second studs to retain said first and second studs in abutting relationship with each other.

30. The support structure of claim 29 wherein each said stud engagers comprises a notch in said elongated connector.

31. The support structure of claim 30 wherein said elongated connector has an elongated axis and wherein each said notch extends at an incline to the longitudinal axis of said elongated connector.

32. The support structure of claim 29 wherein said elongated connector has a V-shaped cross-sectional shape.

33. A window jamb comprising:

a first member having at least two flanges connected by a substantially planar web;

an opening through said web of said first member;

a second member having at least two flanges connected by a another substantially planar web having another opening, therethrough, said second member oriented in abutting contact with said first member such that said web is not directly connected to said another web and said another opening is aligned with said opening in said web of said first member;

an elongated jamb connector having a V-shaped cross-sectional shape and extending through said opening and said another opening; and retainers in said elongated jamb connector, wherein at least one retainer engages said web of said first member and wherein at least one other retainer engages said another web of said second member such that said first and second members are rigidly retained in abutting relationship with each other to form a window jamb without use of additional fastening means through said web of said first member and said another web of said second member.

34. The window jamb of claim 33 wherein each said retainer comprises a notch in said elongated jamb connector.

35. The window jamb of claim 34 wherein said elongated jamb connector has an elongated axis and wherein each said notch extends at an incline to the longitudinal axis of said elongated jamb connector.

36. A window jamb comprising:

a first stud having at least two flanges connected by a web;

an opening through said web of said first stud;

a second stud having at least two flanges connected by a web;

another opening through said web of said second stud, said another opening aligned with said opening in said web of said first stud;

an elongated jamb connector having two ends with at least one fastener hole in at least one said end thereof, said elongated jamb connector extending through said opening and said another opening; and stud engagers in said elongated jamb connector, wherein at least one stud engager engages said web of said first stud and wherein at least one other stud engager engages said web of said second stud such that said first and second studs are retained in abutting relationship with each other to form a window jamb.

37. The window jamb of claim 36 wherein each said stud engager comprises a notch in said elongated jamb connector.

38. The window jamb of claim 37 wherein said elongated jamb connector has an elongated axis and wherein each said notch extends at an incline to the longitudinal axis of said elongated jamb connector.

39. The window jamb of claim 36 wherein said elongated jamb connector has a V-shaped cross-sectional shape.

40. A support structure comprising:

a first vertically extending stud having at least two flanges connected by a first web;

an opening through said first web of said first stud;

a second vertically extending stud having at least two flanges connected by a second web having another opening therethrough, said second member oriented in abutting contact with said first member such that said web is not directly connected to said another web and said another opening is aligned with said opening in said first web;

an elongated connector extending through said opening and said another opening, said elongated connector having two ends and a least one fastener hole in at least one said end thereof; and stud engagers in said elongated connector for engaging the webs of said first and second studs to retain said first and second studs in abutting relationship with each other, when said elongated connector is inserted into the openings of said first and second studs and further moved within said opening and said another opening in a direction that is substantially parallel to said first and second webs to bring said stud engagers into engagement with said first and second webs.

41. The support structure of claim 40 wherein each said stud engagers comprises a notch in said elongated connector.

42. The support structure of claim 41 wherein said elongated connector has an elongated axis and wherein each said notch extends at an incline to the longitudinal axis of said elongated connector.

43. A window jamb comprising:

a first vertically extending stud having at least two flanges connected by a web;

an opening through said web of said first stud;

a second vertically extending stud having at least two flanges connected by another webs said another web having another opening, therethrough, said second stud oriented in abutting contact with said first stud such and wherein said another web is not directly attached to said another web and said another opening is aligned with said opening in said web of said first stud;

an elongated jamb connector extending through said opening and said another opening, said elongated jamb connector having two ends and at least one fastener hole in at least one said end thereof; and stud engagers in said elongated jamb connector, wherein at least one stud engager engages said web of said first stud and wherein at least one other stud engager engages said another web of said second stud such that said first and second studs are retained in abutting relationship with each other to form a window jamb when said elongated jamb connector is inserted through said opening and said another aligned opening and further moved within said opening and said other aligned opening in a direction that is substantially parallel to said web of said first stud and said another web of said second stud to bring said stud engagers into retaining engagement with said web and said another web.

44. The window jamb of claim 43 wherein each said stud engager comprises a notch in said elongated jamb connector.

45. The window jamb of claim 44 wherein said elongated jamb connector has an elongated axis and wherein each said notch extends at an incline to the longitudinal axis of said elongated jamb connector.

46. The window jamb of claim 43 wherein said elongated jamb connector has a V-shaped cross-sectional shape.

47. A support structure comprising:

a first stud having at least two flanges connected by a web;

an opening through said web of said first stud;

a second stud having at least two flanges connected by a web having another opening therethrough, said second stud oriented in abutting contact with said first stud such that said web is not directly connected to said another web and said another opening is aligned with said opening in said web of said first stud;

an elongated connector having a V-shaped cross-sectional shape and extending through said opening and said another opening, said elongated connector having two ends with at least one fastener hole in at least one said end thereof; and stud engagers in said elongated connector for engaging the webs of said first and second studs to retain said first and second studs in abutting relationship with each other.

48. The support structure of claim 47 wherein each said stud engagers comprises a notch in said elongated connector.

49. The support structure of claim 48 wherein said elongated connector has an elongated axis and wherein each said notch extends at an incline to the longitudinal axis of said elongated connector.

50. A method of constructing a support structure comprising:

supporting a first stud having a first substantially planar web with at least one first opening therethrough in a vertical orientation;

supporting a second stud having a second substantially planar web with at least one second opening therethrough in abutting relationship with the first stud to form the support structure such that at least one of the first openings in the first web of the first stud is aligned with at least one of the second openings in the web of the second stud to form at least one pair of aligned openings, and such that the first and second substantially planar webs are not otherwise directly attached to each other;

inserting an elongated connector through at least one pair of aligned openings; and moving the elongated connector in the pair of aligned openings in a direction that is substantially parallel to said first and second webs to bring portions of said first and second webs into retaining engagement with the jamb connector, such that said first and second studs are rigidly retained in abutting relationship with each other without use of additional fastening means through said first and second webs.

* * * * *